US005742255A

United States Patent [19]

Afendras

[11] Patent Number: 5,742,255

[45] Date of Patent: Apr. 21, 1998

[54] APERTURE FED ANTENNA ASSEMBLY FOR COUPLING RF ENERGY TO A VERTICAL RADIATOR

[75] Inventor: George D. Afendras, Glenview, Ill.

[73] Assignee: Maxrad, Inc., Hanover Park, Ill.

[21] Appl. No.: 739,502

[22] Filed: Oct. 28, 1996

Related U.S. Application Data

[63] Continuation of Ser. No. 273,714, Jul. 12, 1994, abandoned.

[51] Int. Cl.[6] ..... H01Q 1/32

[52] U.S. Cl. ..... 343/713; 343/715; 333/24 C

[58] Field of Search ..... 343/713, 715, 343/700 MS, 829, 830, 846, 847, 848, 850, 860, 863; 333/24 C; H01Q 7/32, 1/38

[56] References Cited

U.S. PATENT DOCUMENTS

| | | | |
|---|---|---|---|
| Re. 33,743 | 11/1991 | Blaese . | |
| 4,089,817 | 5/1978 | Kirkendall . | |
| 4,621,243 | 11/1986 | Harada | 333/24 C |
| 4,785,305 | 11/1988 | Shyu | 343/713 |
| 4,857,939 | 8/1989 | Shiazaki . | |
| 4,931,805 | 6/1990 | Fisher | 343/713 |
| 4,931,806 | 6/1990 | Wunderlich | 343/715 |
| 4,939,484 | 7/1990 | Harada . | |
| 4,992,800 | 2/1991 | Parfitt . | |
| 5,043,738 | 8/1991 | Shapiro et al. | 343/700 MS |
| 5,059,971 | 10/1991 | Blaese | 343/713 |
| 5,099,252 | 3/1992 | Bryant et al. . | |
| 5,448,250 | 9/1995 | Day | 343/713 |
| 5,451,966 | 9/1995 | Du et al. . | |
| 5,565,877 | 10/1996 | Du et al. | 343/715 |

*Primary Examiner*—Donald T. Hajec
*Assistant Examiner*—Tan Ho
*Attorney, Agent, or Firm*—Wallenstein & Wagner, Ltd.

[57] ABSTRACT

An antenna assembly (10) for use in combination with a glass window (60) and a signal transmission line (110) carrying a electrical transmission signal (S) with a first connector (C) at one end and having a preselected electrical impedance is disclosed. The assembly (10) includes a conductive plate (70) secured to the window (60) and a radiating antenna (80) connected to the plate (70). A ground plane (40) with an aperture (50) therein is secured to the window (60). A feed substrate (30) is connected to the ground plane (40). A microstrip feedline (20) and a second connector (120) attached thereto are connected to the feed substrate (30). The microstrip feedline (20) has an electrical impedance approximately equal to the preselected electrical impedance.

35 Claims, 3 Drawing Sheets

APERTURE FED ANTENNA ASSEMBLY FOR COUPLING RF ENERGY TO A VERTICAL RADIATOR

This is a continuation of U.S. patent application Ser. No. 08/273,714, filed Jul. 12, 1994, now abandoned.

DESCRIPTION

1. Technical Field

The present invention relates generally to antenna systems, and more particularly, to mobile communications antenna systems operating at frequencies in the range from 800–900 MHz.

2. Background of the Invention

Typically, mobile communications antenna systems, many of which operate at a carrier frequency between 800–900 MHz, are installed on the rear window of a vehicle. The principal radiating portion of the antenna is located on the outside of the vehicle, while a communication line which is coupled to a transducer assembly—i.e., an RF communications device and its associated circuitry—is located on the inside of the vehicle.

There have been two principal methods of coupling the transmitted energy from the inside to the outside of the window, namely capacitive coupling and inductive coupling. For example, U.S. Pat. No. 4,931,806 to Wunderlich shows a window-mounted antenna for a cellular mobile telephone which uses capacitive coupling. Both capacitively and inductively coupled antennas, however, require impedance matching circuitry. Often, such circuitry contains one or more discrete-lumped passive elements, as shown in Wunderlich, which have a tendency to deteriorate over time.

Consequently, there is a need for an antenna system which does not contain such passive elements for impedance matching in order to limit tuning degradation.

Some in the field have resorted to parasitic elements and the like to remove passive components, while continuing to capacitively couple signals to and from the transmission line and the principal radiating antenna. For example, U.S. Pat. No. 4,882,592 to Studer, Jr., et. al. describes a mobile communications antenna which uses capacitive coupling. The antenna contains a communications coupling box which supports a fiberglass printed circuit board having conductive patterns on both its outwardly and inwardly facing surfaces. A conductor is connected to one of the conductive patterns and is placed at a particular location. Due to the construction of the conductive patterns and the location of the conductor, the coupling box needs no tuning device to impedance match signals transmitted to the antenna. However, construction of the above-mentioned antenna can be complicated and appears to be costly.

Several articles have been written on aperture coupling techniques, including two written by David M. Pozar. The first article, entitled "Microstrip Antenna Aperture-Coupled to a Microstripline," *Electronics Letters,* vol. 21, pp. 49–50, Jan. 17, 1985, describes the general method of feeding a patch antenna without a direct connection between the patch antenna and the microstrip feedline. The antenna system described in the article has a microstrip feedline connected to the first side of a first dielectric substrate. A ground plane, with an aperture therein, is placed over the second side of the first dielectric substrate. A second dielectric substrate has its bottom placed over the ground plane. A patch antenna, as opposed to a radiating whip, is connected to the top of the second dielectric substrate and is located over the aperture.

The prototype system described operates at 2.14 GHz; however, models were made and tested at C-band and K-band frequencies.

The second article, entitled "A Reciprocity Method of Analysis for Printed Slot and Slot-Coupled Microstrip Antennas," *IEEE Transactions on Antennas and Propagation,* Vol. AP-34, No. 12, December 1986, builds upon the first article and is directed to deriving basic formulae to calculate the specific geometries of both the microstripline-fed printed slot and the aperture-coupled microstrip patch. These basic formulae are then extended to moment method solutions. The results are compared with impedance measurements. Part IV of the article focuses on the moment method solution for the aperture-coupled patch antenna.

Pozar's articles generally show aperture-coupling from a microstrip feedline to a patch antenna. However, the articles do not discuss designing an aperture-coupled system which uses a vertical radiator connected to the patch antenna. The articles also fail to show the use and mechanics of such a design for communications in which the window of a vehicle forms the second dielectric substrate. Specifically, the articles do not mention orienting the aperture in the ground plane to vertically polarize the transmitted signal to properly feed the vertical radiator (although both FIG. 1 and FIG. 6 do show the aperture being oriented normal to the microstrip feedline as found in the present invention) or the need for providing a lengthened patch to ensure proper transmission of the radiated signals. Further, Pozar's articles do not discuss the sizing and problems encountered at the operating frequencies of the present invention. Finally, the bandwidth of Pozar's antenna is very narrow.

The antenna assembly of the present invention provides an alternative method of coupling signals from a transmission line to a radiating antenna in a communication system without requiring a direct electrical or mechanical contact.

SUMMARY OF THE INVENTION

According to a first aspect of the present invention, an antenna assembly for use in combination with a glass window having an inside surface and an outside surface and a signal transmission line carrying a transmission signal with a first connector at one end and having a preselected electrical impedance for a communications device is disclosed. The assembly includes a conductive plate secured to the outside of the window and a radiating antenna conductively connected to the plate. A ground plane has an upper surface and a lower surface with the upper surface being secured to the inner surface of the window. The ground plane also has an aperture therein. A feed substrate has an upper surface and a lower surface with the upper surface being connected to the lower surface of the ground plane. A microstrip feedline is connected to the lower surface of the feed substrate, and connection means are provided for conductively connecting the microstrip feedline to the first connector of the signal transmission line. The microstrip feedline has an impedance approximately equal to the preselected impedance.

The antenna of the present invention is designed to match the impedance of the transmission line through sizing and orienting the assembly elements instead of using discrete-lumped passive elements. Further, unlike previous designs which used capacitive coupling and inductive coupling, the antenna system of the present invention uses aperture-coupling to feed a lengthened conductive plate.

In a second embodiment of the invention, a vertical radiating antenna is not used with the antenna assembly. Hence, the conductive plate acts as the radiating antenna.

Other features and advantages of the invention will be apparent from the following specification taken in conjunction with the following drawings.

BRIEF DESCRIPTION OF THE DRAWINGS

In order that the present invention may be understood, it will now be described by way of example, with reference to the accompanying drawings in which.

DETAILED DESCRIPTION OF THE PREFERRED EMBODIMENT

Figure 1:
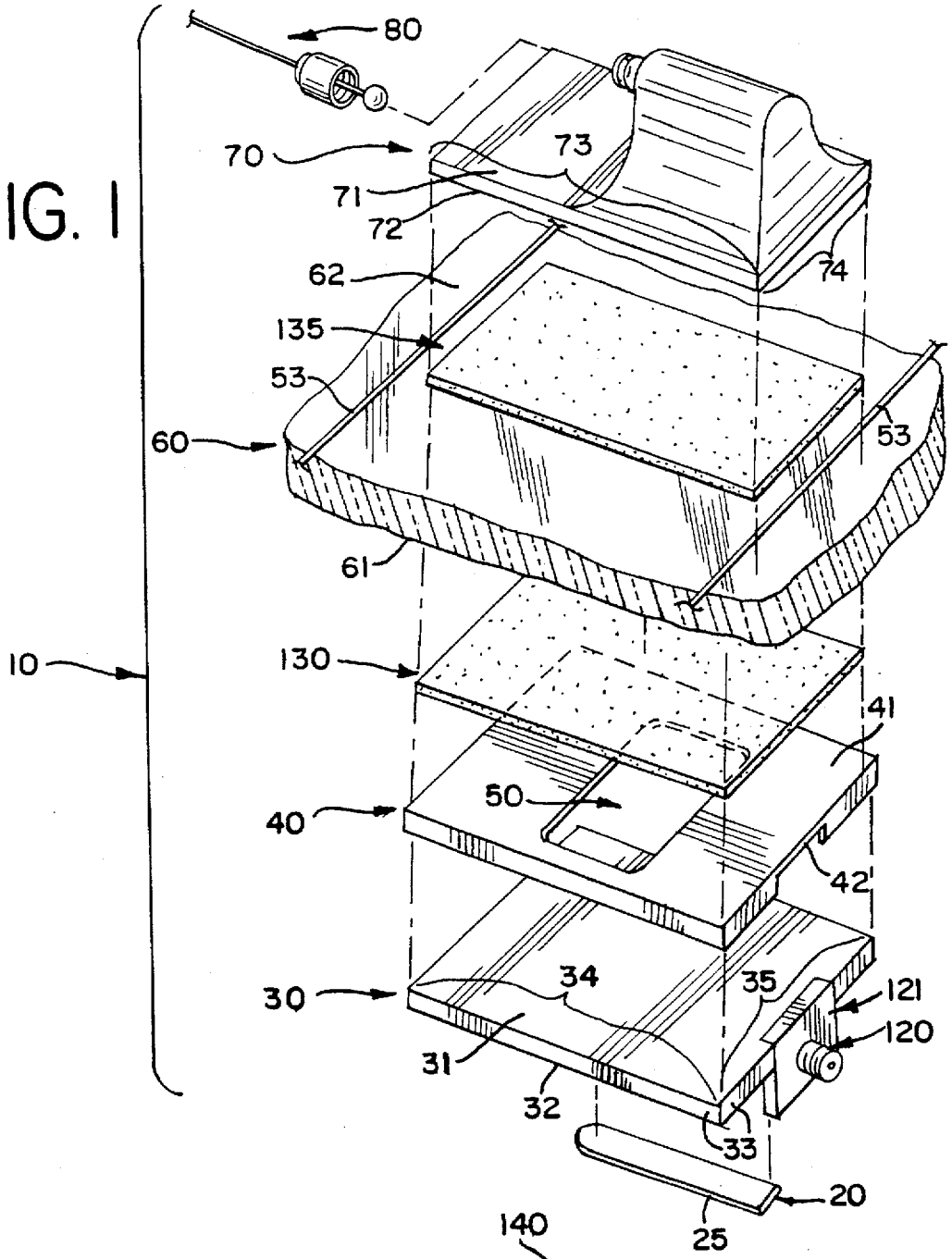
FIG. 1 is an exploded view of the antenna assembly of the present invention.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

The antenna assembly of the present invention, generally designated by reference numeral 10, is shown in FIG. 1. The antenna system includes the following primary components: a second connector 120, a microstrip feedline 20, a feed substrate 30, a ground plane 40 with an aperture 50 therein, a glass window 60, a conductive plate 70, and a radiating antenna 80. The feed substrate 30 has an upper surface 31 and a lower surface 32. A microstrip feedline 20 is attached to the lower surface 32 of the feed substrate 30 and a ground plane 40 is attached to the upper surface 31 of the feed substrate. The ground plane 40 has an aperture 50 therein. This ground plane 40 is attached, via its upper surface 41, to the inside 61 of glass window 60. The window 60 also has an outside surface 62 which is attached to the conductive patch 70 (lower surface 72). The radiating antenna 80 is both conductively and physically connected to the conductive plate 70.

The antenna assembly 10 is designed to both transmit and receive communications signals which have a carrier frequency in the range from approximately 800 to 900 MHz.

The feed substrate 30, in addition to having an upper surface 31 and a lower surface 32 of first longitudinal length 34 and a first transverse width 35, also has side surfaces 33. Furthermore, the feed substrate 30 contains a notched portion 36 which receives a connector support 121. The thickness of the connector support 121 and the depth of the notched portion 36 are approximately equal so that the connector support 121 lies flush along the first transverse width 35 of the feed substrate 30. In the preferred design, the feed substrate is rectangular in shape and is made of FR-4 or G-10 glass epoxy available from Atlas Fibre Company. Materials FR-4 and G-10 have dielectric constants of approximately 4.8.

Generally, a wave traveling within a dielectric material has a wavelength inversely proportional to the dielectric constant of the dielectric material. Hence, a dielectric material with an appropriate dielectric constant for communications carrier frequencies in the range between approximately 800–900 MHz is needed.

Experimentation was conducted with RT Duriod of Rogers Corporation, Delrin Polymer of DuPont Corporation and FR-4 glass epoxy noted above. FR-4 glass epoxy material is preferred by the inventor in that its properties were found to best meet the antenna systems' size and electrical requirements. However, it will be understood that other dielectrics having essentially the same properties as FR-4 can be substituted therefor, such as G-11 (glass epoxy), G-7 (glass silicone), N-1 (nylon phenolic) and XXX (paper phenolic) having dielectric constants of 5.0, 4.2, 4.9, and 5.1, respectively. All of these materials are available from Atlas Fibre Company.

As noted above, the antenna system 10 operates preferably between 800 to 900 MHz. Since the thickness of the substrate and the bandwidth are directly related, the thickness of the substrate is chosen for the antenna system to operate over the frequency range of interest. To this end, the feed substrate 30 was experimentally determined to be preferably ⅛ of an inch thick.

The feed substrate 30, as commercially sold, has conductive coating on both its upper surface 31 and its lower surface 32 (1 oz. copper cladding). The conductive coating on the lower surface 32 of the feed substrate is etched away to leave a microstrip feedline 20. The conductive coating on the upper surface 31 of the feed substrate 20 is etched away to form an aperture 50 in the ground plane 40 (see FIGS. 3 and 4).

Figure 4:
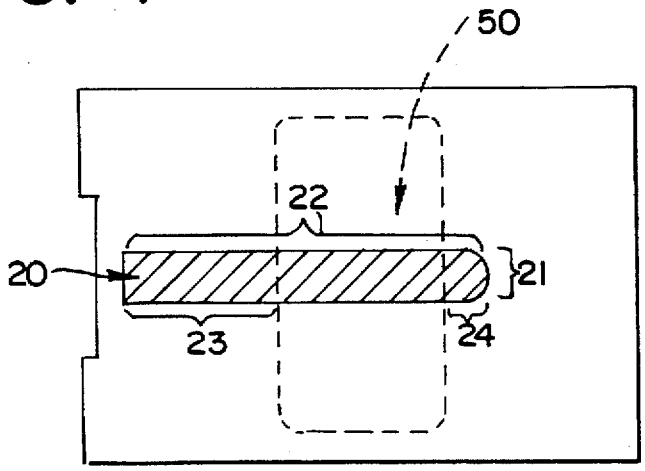
FIG. 4 is a bottom view of the feed substrate of the present invention.

The microstrip feedline 20 has a standard commercially available RF connector 120 for a coaxial transmission line attached to one of its ends. The length of the microstrip feedline 20 is designed to be approximately a quarter-wavelength of the carrier frequency of the signal traveling in the substrate. As best shown in FIG. 4, the microstrip feedline 20 has a width 21, a length 22, a first portion overhang (closest to the connection) 23, a second portion overhang (distal end) 24 and a thickness 25 (See FIG. 1). The width 21, the first portion overhang 23 and second portion overhang 24 determine the impedance for the system. The width 21, the first portion overhang 23, and second portion overhang 24 are selected to match the 50 ohm impedance of the transmission line 110.

Referring now to FIG. 1, the ground plane 40 has an upper surface 41 and a lower surface 42. The lower surface of the ground plane is connected to and covers the upper surface 31 of the feed substrate 30. In the preferred embodiment, the ground plane 40 is made of copper and covers the side surfaces 33 of the feed substrate 30 to prevent electromagnetic leakage through the side surfaces 33 of the feed substrate 30. As mentioned above, this ground plane 40 has an aperture 50 therein.

Figure 3:
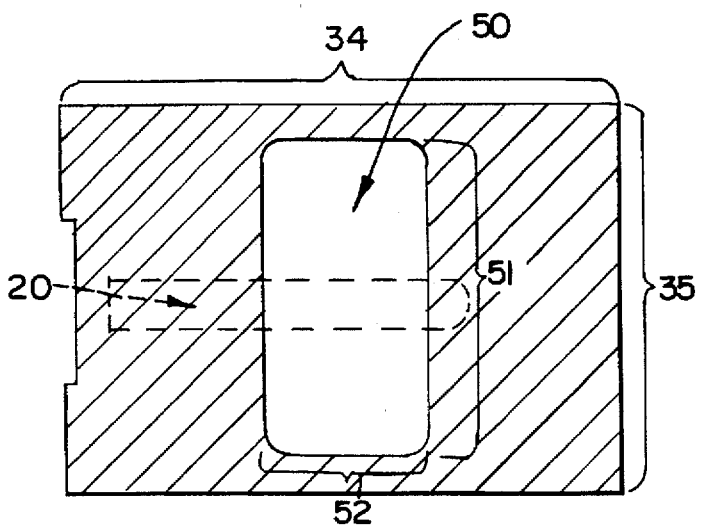
FIG. 3 is a top view of the feed substrate of the present invention.

As shown in FIGS. 3 and 4, the aperture 50 is rectangular and is centered on the upper surface 31 of the feed substrate 30. The width 51 of the coupling aperture 50 is greater than its length 52. The orientation of the aperture 50 is normal to the microstrip feedline 20 so as to vertically polarize the transmission signal as it is being electromagnetically transmitted through the aperture 50. Further, the length 52 of the aperture 50 is less than the length 22 of the microstrip feedline 20. As will be appreciated by those skilled in the art, the sizing of the aperture 50 effects both the impedance matching of the entire system and the efficiency in energy transfer to the conductive plate 70.

Since vehicle defroster wires 53 (see FIG. 1) consist of metal, some of the transmission of electromagnetic current from the microstrip feedline 20 through the aperture 50 to the conductive patch 70 can be intercepted. In order to minimize the interference by the defroster wires, the aperture 50 fits between adjacent defroster wires.

The glass window 60 is preferably the rear window of a vehicle (not shown). The properties of glass windows found on vehicles may vary based upon their thickness and their construction. For example, the glass windows of different automobile manufacturers may have a variety of dielectric constants. The dielectric constant of most automotive glass is in the range of approximately 5.0 to 7.0. The antenna assembly 10 is designed to account for most variations in commercial glass windows used in vehicles.

The ground plane 40 is attached to the inside surface 61 of the glass window 60 by a first piece of double-sided tape 130. In the preferred embodiment, the first piece of double-sided tape 130 is double-sided acrylic foam tape available from 3M Corporation. This first piece of double-sided tape 130 is approximately equal to the first longitudinal length 34 of the feed substrate 30.

The conductive plate 70 has an upper surface 71, a lower surface 72, a second longitudinal length 73, and a second transverse width 74. The lower surface 72 of the conductive plate 70 is attached to the outside surface 62 of the glass window 60 by a second piece of double-sided tape 135. In the embodiment shown, the second piece of double-sided tape 135 is also made of acrylic foam. The length of the tape 135 is approximately equal to the second longitudinal length 73 of the conductive plate 70. The conductive plate, in the preferred embodiment, is made of 6061 T6 aluminum. It should be understood that other conductive materials can be substituted for the aluminum specified in the preferred embodiment.

In order to properly transmit and receive the communications signals, the conductive plate 70 is dimensioned to receive signals which pass through the feed substrate 30 and the glass window 60, along with the two pieces of double-sided tape 130 and 135, before reaching the conductive plate 70. The signal, as it passes through these materials, may have a new wavelength different from its initial wavelength. As a result, elements are sized to consider this fluctuation. Specifically, the feed substrate 30 has a first longitudinal length 34 and first transverse width 35. As mentioned above, the conductive plate 70 has a second longitudinal length 73 and a second transverse width 74. The second longitudinal length 73 is greater than the first longitudinal length 34 while the first transverse width 74 and the second transverse width 35 are approximately equal. Such sizing accommodates for any changes in the wavelength of the signal as it passes through the materials. Specifically, the second longitudinal length 73 is sized to be approximately equal to the size of a quarter-wave of the signal being transmitted as it passes through the glass window 60.

The conductive plate 70 is placed on the outside surface 62 of the glass window 62 so that it is centered over the feed substrate 30. In the preferred embodiment, the radiating antenna 80 is conductively and physically connected to the conductive plate 70 by a connection assembly 140 having a mount base 145 and a lock pivot mechanism 150. The radiating antenna 80 is centered on the conductive plate 70 so that it is also centered over the aperture 50.

The vertical radiating antenna 80 must be large enough to clear the metallic roof of the vehicle (not shown), which can act as a ground plane, to overcome any "RF"-shielding. In the preferred embodiment, the vertical radiating antenna 80 is of resonant length at the frequency of interest. As will be understood by those skilled in the art, the vertical radiating antenna 80 may be a quarter-wave, a ⅝ths-wave, a half-wave or a stacked half-wave antenna. Furthermore, the stacked half-wave antenna may have one or more phasing coils.

Figure 2:
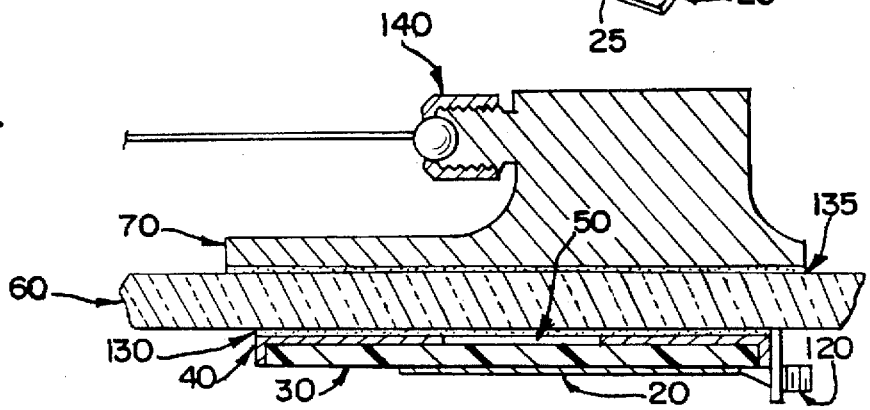
FIG. 2 is a sectional side-elevational view of the antenna assembly of FIG. 1.
Figure 5:
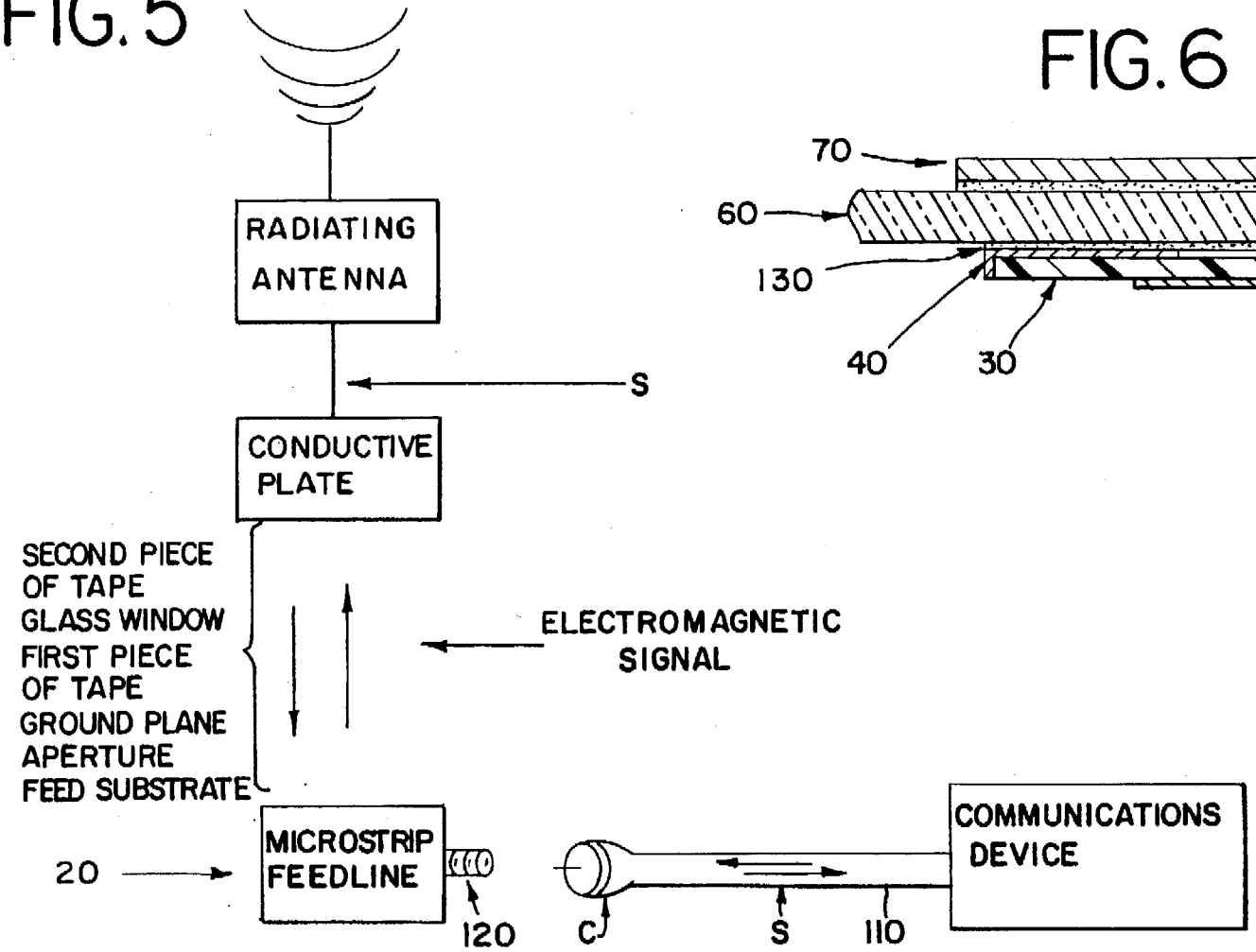
FIG. 5 is a block diagram showing communication to and from a RF communications device using the antenna assembly of the present invention; and, FIG. 6 is a sectional side-elevational view of a second embodiment of the antenna assembly of the present invention.

Referring to FIGS. 1 and 5, in the transmission mode, a communications device sends electrical signals or transmission line signals S along a transmission line 110 having a first connector C through a second, cooperating connector 120 to the microstrip feedline 20. The microstrip feedline 20 couples the signals through the feed substrate 30, the aperture 50 and the glass window 60 to the metallic plate 70. During their transmission, the signals S are vertically polarized, by the orientation of the aperture 50 in the ground plane 40 to ensure proper feeding of the radiating antenna 80. the signals S pass from the conductive plate 70 through a connection assembly 140 (see FIG. 2) to the radiating antenna 80. The antenna then transmits the signal to a cellular station or the like.

The antenna assembly 10 has been described above in transmission mode for ease of understanding. The antenna assembly 10 operates in receiving mode as well. In the receiving mode, the radiating antenna 80 receives a communications signal S transmitted from an outside source which is coupled to the microstrip feedline 20 via a connection assembly 140 to the conductive patch 70 through the glass window 60, the aperture 50 and the feed substrate 30. The signal is then passed from the microstrip feedline 20 through the second connector 120 and the first connector C along the transmission line 110 to a communications device. The signal is then processed by the internal circuitry of the communications device and converted to usable form.

Figure 6:
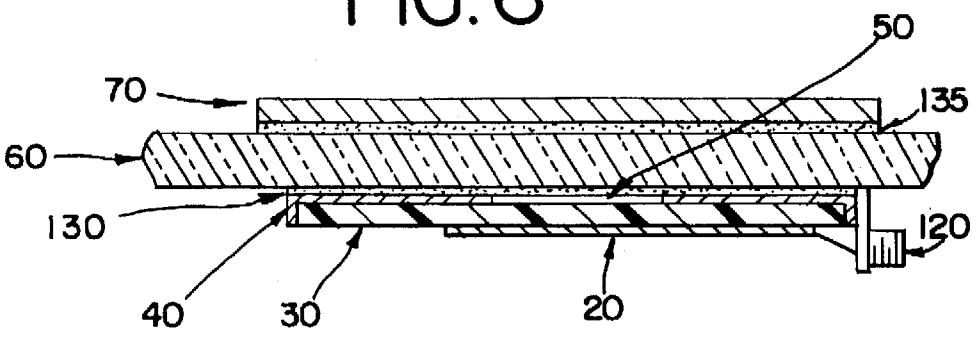

In a second embodiment of the invention, no vertical radiating antenna 80 or connection assembly 140 is used (see FIG. 6). The operation is identical to the embodiment described above, except the conductive plate 70 acts as the transmitting/receiving antenna. The physical dimensions of the second embodiment are identical to those of the preferred embodiment.

The formulae provided in the earlier-mentioned articles by Pozar do not yield an efficient antenna system for the application described herein. Using Pozar's formulae, an aperture-coupled antenna system having carrier frequencies in the 800–900 MHz range would have the following dimensions:

| | |
|---|---|
| Feed Substrate | |
| first longitudinal length = | 2.6 |
| first longitudinal width = | 1.5 |
| thickness = | 0.0625 |
| Microstrip Feedline | |
| (1 oz. copper cladding) | |
| length = | 1.625 |
| width = | 0.125 |
| first portion overhang = | 0.75 |
| second portion overhang = | 0.375 |
| thickness = | 0.089 mm |
| Ground Plane | |
| (1 oz copper cladding) | |
| Aperture | |
| length = | 0.625 |
| width = | 0.9375 |

-continued

| | |
|---|---|
| Conductive Patch | |
| second longitudinal length = | 2.6 |
| second longitudinal width = | 1.5 |

It was experimentally determined, however, that the dimensions calculated through use of Pozar's formulae do not yield the optimal solution for the desired antenna system.

Specifically, the following prototypes were constructed: (1) an antenna sized according to the formulae provided by Pozar ("Pozar—NoWhip"); (2) an antenna sized in accordance with Pozar having a vertical radiating antenna connected to the patch ("Pozar—With Whip"); (3) an antenna dimensioned in accordance with the first embodiment of the invention ("Maxrad—With Whip"); and, (4) an antenna sized in accordance with the second embodiment of the invention ("Maxrad—No Whip"). The experiments were conducted on a far field, ground reflection type, test range. The test setup consisted of a source antenna, mounted on a metal tower, and the prototypes located a specific distance and height away from the transmit antenna. Each prototype was rotated 360 degrees about the transmit antenna and the relative signal strengths were measured and plotted to yield a radiation pattern. The tests were conducted at 826; 846 and 875 MHz, three frequencies broadly covering of the specific band of interest. No roofline was used.

The results of the tests indicated that the Maxrad—With Whip antenna outperformed all the other prototypes. Furthermore, the Maxrad—No Whip antenna had better performance characteristics than the Pozar—No Whip and the Pozar—With Whip antennas. Additionally, the Pozar—With Whip antenna, on average, performed about the same as the Pozar—No Whip antenna.

Specifically, the results showed that the Maxrad—No Whip antenna had an average antenna gain of nearly 4 dB greater than the Pozar—No Whip antenna and Pozar—With Whip antennas. When a vertical radiator was added to the Maxrad—No Whip design resulting in a Maxrad—With Whip antenna, the average antenna gain increased almost another 2 dB.

As experimentally determined, the dimensions (in inches) of the preferred embodiment of the present invention are as follows:

| | |
|---|---|
| Feed Substrate | |
| (FR-4 having dielectric constant of 4.8) | |
| first longitudinal length = | 2.50 |
| first longitudinal width = | 1.50 |
| thickness = | 0.125 |
| Microstrip Feedline | |
| (1 oz. copper cladding) | |
| length = | 1.625 |
| width = | 0.1875 |
| first portion overhang = | 0.6875 |
| second portion overhang = | 0.1875 |
| thickness = | 0.089 mm |
| Ground Plane | |
| (1 oz copper cladding) | |
| Aperture | |
| length = | 0.750 |
| width = | 1.25 |

-continued

| | |
|---|---|
| Conductive Patch | |
| (6061 T6 Aluminum) | |
| second longitudinal length = | 2.75 |
| second longitudinal width = | 1.5 |
| Radiating Antenna | |
| (Resonant Length) | |
| quarter-wave; | |
| ⅝ths-wave; | |
| half-wave; or | |

stacked half-wave with one or more phasing coils.

Since sizing of the antenna system is proportional to frequency, it should be understood that the system can be scaled to operate at other frequency ranges.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An antenna assembly for use in combination with a glass window having an inside surface and an outside surface and a signal transmission line, with a connector at one end, carrying a transmission signal and having a preselected electrical impedance comprising:

a microstrip feedline receiving and transmitting the transmission signal;

a radiating antenna receiving and transmitting the transmission signal;

means disposed between the radiating antenna and the microstrip feedline for electromagnetically, aperture coupling the transmission signal between the radiating antenna and the microstrip feedline signal by the transmission signal electromagnetically passing through the window, the transmission signal being solely vertically polarized as it passes through the window; and, connection means for conductively connecting the microstrip feedline to the connector of the signal transmission line.

2. The antenna assembly as defined in claim 1 wherein the means disposed between the radiating antenna and the microstrip feedline for electromagnetically, aperture coupling the transmission signal between the radiating antenna and the microstrip feedline signal by the transmission signal electromagnetically passing through the window includes:

a conductive plate secured to the outside of the window conductively connected to the radiating antenna;

a ground plane having an upper surface and a lower surface with the upper surface being secured to the inner surface of the window, the ground plane having an aperture therein; and, a feed substrate having an upper surface and a lower surface with the upper surface being connected to the lower surface of the ground plane and the lower surface being connected to the microstrip feedline.

3. The antenna assembly as defined in claim 2 wherein the microstrip feedline has an electrical impedance approximately equal to the preselected electrical impedance.

4. An antenna assembly for use in combination with a glass window having an inside surface and an outside surface and a signal transmission line, with a connector at one end, carrying a transmission signal and having a preselected electrical impedance comprising:

a metallic conductive plate secured to the outside of the window;

a radiating antenna conductively connected to the conductive plate, the transmission signal having a carrier frequency and the radiating antenna having a length approximately one-quarter the wavelength of the carrier frequency;

a metallic ground plane having an upper surface and a lower surface with the upper surface being secured to the inner surface of the window, the metallic ground plane having an aperture therein, the lower surface of the conductive plate having a first surface area and the aperture in the ground plane having a second surface area, the first surface area being greater than the second area;

a feed substrate having an upper surface and a lower surface and at least one side surface with the upper surface being connected to the lower surface of the ground plane, the feed substrate having a first longitudinal length and a first transverse width and the conductive plate having a second longitudinal length and a second transverse width, the second longitudinal length being greater than the first longitudinal length and the first transverse width being approximately equal to the second transverse width, the ground plane covering the upper surface and the side surface of the feed substrate;

a metallic microstrip feedline connected to the lower surface of the feed substrate; and, connection means for conductively connecting the microstrip feedline to the connector of the signal transmission line.

5. The antenna assembly as defined in claim 4 wherein the first longitudinal length is approximately 2.5 inches and the first transverse width is approximately 1.5 inches and the second longitudinal length is approximately 2.75 inches and the second transverse width is approximately 1.5 inches.

6. The antenna assembly as defined in claim 5 wherein the aperture in the ground plane is generally rectangular in shape and is normal to the microstrip feedline.

7. The antenna assembly as defined in claim 6 wherein the aperture in the ground plane has a length of approximately 0.750 inches and a width of approximately 1.25 inches, the feed substrate has a dielectric constant of approximately 4.8, and a thickness of approximately 0.125 inch.

8. The antenna assembly as defined in claim 7 wherein the lower surface of the conductive plate and the upper surface of the ground plane are secured to the outer and inner surfaces of the window respectively by double sided tape.

9. The antenna assembly as defined in claim 8 wherein the window is secured to a vehicle having at least one upper vehicle ground plane which acts as a radio frequency shield and the radiating antenna projects upwardly above the upper vehicle ground plane of the vehicle.

10. The antenna assembly as defined in claim 9 wherein the window is secured to a vehicle having a roof and the radiating antenna projects upwardly above the roof of the vehicle.

11. An antenna assembly for use in combination with a glass window having an inside surface and an outside surface and a signal transmission line, with a connector at one end, carrying a transmission signal and having a preselected electrical impedance comprising:

a ground plane having an upper surface and a lower surface with the upper surface being secured to the inner surface of the window and an aperture therein;

a feed substrate having an upper surface, a lower surface, a first longitudinal length and a first longitudinal width, the upper surface of the feed substrate being connected to the lower surface of the ground plane;

a conductive plate secured to the outside of the window, the conductive plate having a second longitudinal length and a second transverse width, the second longitudinal length being greater than the first longitudinal length and the second transverse width being approximately equal to the first transverse width;

a microstrip feedline connected to the lower surface of the feed substrate; and, connection means for conductively connecting the microstrip feedline to the connector of the signal transmission line.

12. The antenna assembly as defined in claim 11 wherein the first longitudinal length is approximately 2.5 inches and the first transverse width is approximately 1.5 inches and the second longitudinal length is approximately 2.75 inches and the second transverse width is approximately 1.5 inches.

13. The antenna assembly as defined in claim 12 wherein the aperture in the ground plane is generally rectangular in shape and is normal to the microstrip feedline.

14. The antenna assembly as defined in claim 14 wherein the aperture in the ground plane has a length of approximately 0.750 inches and a width of approximately 1.25 inches, the feed substrate has a dielectric constant of approximately 4.8, and a thickness of approximately 0.125 inch.

15. The antenna assembly as defined in claim 14 wherein the lower surface of the conductive plate and the upper surface of the ground plane are secured to the outer and inner surfaces of the window respectively by double sided tape.

16. The antenna assembly as defined in claim 11 wherein the microstrip feedline has an electrical impedance approximately equal to the preselected electrical impedance.

17. The antenna assembly as defined in claim 11 wherein the conductive plate, the ground plane and the microstrip feedline are constructed of a metal.

18. The antenna assembly as defined in claim 17 wherein the transmission signal has a carrier frequency and the radiating antenna is of approximately resonant length.

19. The antenna assembly as defined in claim 18 wherein the window is secured to a vehicle having at least one upper vehicle ground plane which acts as a radio frequency shield and the radiating antenna projects upwardly above the upper vehicle ground plane of the vehicle.

20. The antenna assembly as defined in claim 19 wherein the window is secured to a vehicle having a roof and the radiating antenna projects upwardly above the roof of the vehicle.

21. A method of transmitting mobile communication signals comprising the steps of:

a) generating an electrical signal which travels along a transmission line and is coupled to a microstrip feedline;

b) radio-frequency coupling the electrical signal from the microstrip feedline through a feed substrate, an aperture in a ground plane, and a dielectric to a vertical radiating antenna connected to a conductive plate, wherein the coupled electrical signal is solely vertically polarized as it passes through the dielectric; and, c) radiating the signal from the vertical radiating antenna to a remote antenna which receives a radiated signal.

22. A method of receiving mobile communication signals comprising the steps of:

a) receiving radiated communication signals via a vertical radiating antenna connected to a conductive plate;

b) coupling the radiated communication signals through a dielectric, an aperture in a ground plane, and a feed substrate to a microstrip feedline, wherein the coupled communication signals are solely vertically polarized as they pass through the dielectric; and, c) coupling the communication signals from the microstrip feedline to a transmission line connected to a communications device.

23. An antenna assembly for use in combination with a glass window having an inside surface and an outside surface and a signal transmission line carrying a transmission signal with a connector at one end and having a preselected electrical impedance comprising:

a single conductive plate secured to the outside of the window;

a vertical radiating antenna conductively connected to the single conductive plate;

a ground plane having an upper surface and a lower surface with the upper surface being secured to the inner surface of the window and a single aperture therein;

a feed substrate having an upper surface and a lower surface with the upper surface being connected to the lower surface of the ground plane;

a single microstrip feedline connected to the lower surface of the feed substrate; and, connection means for conductively connecting the single microstrip feedline to the connector of the signal transmission line, wherein the transmission signal is coupled between the radiating antenna and the microstrip feedline and is solely vertically polarized as it passes through the window.

24. The antenna assembly as defined in claim 23 wherein the feed substrate has one side surface and the ground plane covers the side surface of the feed substrate.

25. The antenna assembly as defined in claim 23 wherein the feed substrate has a plurality of side surfaces and the ground plane covers the plurality of side surfaces of the feed substrate.

26. An antenna assembly for use in combination with a glass window having an inside surface and an outside surface and a signal transmission line carrying a transmission signal with a connector at one end and having a preselected electrical impedance comprising:

a conductive plate secured to the outside of the window;

a radiating antenna conductively connected to the conductive plate;

a ground plane having an upper surface and a lower surface with the upper surface being secured to the inner surface of the window and an aperture therein;

a feed substrate having an upper surface and a lower surface with the upper surface being connected to the lower surface of the ground plane, the feed substrate further having at least one side surface and the ground plane covering the side surface of the feed substrate;

a microstrip feedline connected to the lower surface of the feed substrate; and, connection means for conductively connecting the microstrip feedline to the connector of the signal transmission line.

27. The antenna assembly as defined in claim 26 wherein the microstrip feedline has an electrical impedance approximately equal to the preselected electrical impedance.

28. The antenna assembly as defined in claim 26 wherein the conductive plate, the ground plane and the microstrip feedline are constructed of a metal.

29. The antenna assembly as defined in claim 28 wherein the transmission signal has a carrier frequency and the radiating antenna is of approximately resonant length.

30. The antenna assembly as defined in claim 29 wherein the lower surface of the conductive plate has a first surface area and the aperture in the ground plane has a second surface area, the first surface area being greater than the second surface area.

31. The antenna assembly as defined in claim 30 wherein the feed substrate has a dielectric constant of approximately 4.8.

32. The antenna assembly as defined in claim 31 wherein the feed substrate has a thickness of approximately 0.125 inch.

33. The antenna assembly as defined in claim 32 wherein the lower surface of the conductive plate and the upper surface of the ground plane are secured to the outer and inner surfaces of the window respectively by double sided tape.

34. The antenna assembly as defined in claim 33 wherein the window has a plurality of spaced parallel defrost wires therein or thereon and the aperture in the ground plane is sized to fit between adjacent defrost wires.

35. The antenna assembly as defined in claim 34 wherein the window has the plurality of spaced parallel defrost wires therein or thereon and the lower surface of the conductive plate and the upper surface of the ground plane are secured to the outer and inner surfaces of the window respectively between adjacent defrost wires.

* * * * *